US008967098B2

(12) United States Patent
Khurgin

(10) Patent No.: US 8,967,098 B2
(45) Date of Patent: Mar. 3, 2015

(54) SINGLE-CYLINDER, DUAL HEAD INTERNAL COMBUSTION ENGINE HAVING MAGNETICALLY COUPLED POWER DELIVERY

(71) Applicant: Boris Khurgin, New York, NY (US)

(72) Inventor: Boris Khurgin, New York, NY (US)

( * ) Notice: Subject to any disclaimer, the term of this patent is extended or adjusted under 35 U.S.C. 154(b) by 0 days.

(21) Appl. No.: 14/150,707

(22) Filed: Jan. 8, 2014

(65) Prior Publication Data

US 2014/0116389 A1 May 1, 2014

Related U.S. Application Data

(63) Continuation-in-part of application No. 13/537,248, filed on Jun. 29, 2012, now abandoned.

(51) Int. Cl.
*F02B 71/00* (2006.01)
*F02B 75/00* (2006.01)
*F01M 1/00* (2006.01)

(52) U.S. Cl.
CPC ..... *F02B 75/002* (2013.01); *F01M 1/00* (2013.01); *F02B 71/00* (2013.01)
USPC ..... 123/61 R

(58) Field of Classification Search
CPC ..... F02B 71/00; F02B 71/04; F02B 75/285; F02B 75/002; H02K 7/1869; H02K 7/1876; H02K 33/00; H02K 35/00
USPC ..... 123/61 R
See application file for complete search history.

(56) References Cited

U.S. PATENT DOCUMENTS

| | | | | |
|---|---|---|---|---|
| 2,317,167 | A | 4/1943 | Baer | |
| 3,076,440 | A | 2/1963 | Arnold | |
| 4,261,303 | A * | 4/1981 | Ramsey | 123/50 R |
| 5,351,657 | A * | 10/1994 | Buck | 123/43 C |
| 5,816,202 | A | 10/1998 | Montresor | |
| 5,844,340 | A * | 12/1998 | Noda | 310/103 |
| 7,296,544 | B2 | 11/2007 | Deeke | |
| 7,318,506 | B1 * | 1/2008 | Meic | 290/1 A |
| 7,438,028 | B1 | 10/2008 | Warren | |
| 7,721,685 | B2 * | 5/2010 | Page | 123/43 AA |

FOREIGN PATENT DOCUMENTS

| | | |
|---|---|---|
| DE | 3921581 | 10/1990 |

* cited by examiner

*Primary Examiner* — Lindsay Low
(74) *Attorney, Agent, or Firm* — David L. Banner

(57) ABSTRACT

A single-cylinder, dual head internal combustion engine wherein in a single, mechanically unconstrained piston moves reciprocally within the cylinder between the two heads. Magnets or nonmagnetized ferromagnetic structures in the piston interact with magnets in a sleeve riding on the outside surface of the cylinder to cause synchronous movement of the sleeve. A yoke coupled to the sleeve may be coupled to a conventional crankshaft to convert the reciprocal movement of the sleeve into rotary motion. Multiple single-cylinder, dual head units may be ganged to form multi-cylinder engine configurations. In one embodiment, the magnets in the sleeve are electromagnets whereby de-energizing the electromagnets decouples the sleeve from the piston, thereby eliminating the need for a mechanical clutch in a power train driven by the engine.

20 Claims, 9 Drawing Sheets

SINGLE-CYLINDER, DUAL HEAD INTERNAL COMBUSTION ENGINE HAVING MAGNETICALLY COUPLED POWER DELIVERY

RELATED APPLICATIONS

This is a Continuation-in-Part application of application Ser. No. 13/537,248 for SINGLE-CYLINDER, DUAL-HEAD INTERNAL COMBUSTION ENGINE HAVING MAGNETICALLY COUPLED POWER DELIVERY filed Jun. 29, 2012, that application being included herein in its entirety by reference.

FIELD OF THE INVENTION

The invention pertains to internal combustion engines and, more particularly, to single-cylinder, dual-head internal combustion engines having a single piston moving therein between the heads and wherein the mechanical power generated by the engine is magnetically coupled to an external load.

BACKGROUND OF THE INVENTION

Internal combustion engines are well known. Among the known internal combustion engines, there may be found single-cylinder, dual headed engines. In such engines, a single, dual-faced piston moves within a single-cylinder. A combustion chamber is located at each end of the cylinder, each combustion chamber typically having one or more inlet valves, one or more exhaust valves, and an ignition source (e.g., a spark plug. In these engines, a connecting rod attached to the piston is conventionally connected to a crankshaft and the power generated by the reciprocal motion of the piston is converted by the crankshaft into rotary motion.

Lubrication is provides by oil from the crankcase splashed into the cylinder by the connecting rod.

Intake and exhaust valves may be actuated by a cam shaft disposed at each end of the cylinder.

Such engines of the prior art may be either two-cycle or four cycle (or two-stroke or four-stroke in the vernacular). In a two-stroke engine, a complete combustion cycle is completed for each revolution of the crankshaft, in other words, for each up and down excursion of the piston.

In a four-stroke engine, a combustion cycle requires two revolutions of the crankshaft resulting in two complete up and down excursions of the piston for each combustion cycle.

Such conventional designs, whether two-stroke or four-stroke are typically both bulky and heavy. Two-stroke engines are typically more compact and lighter than four-stroke engines having the same rated power output. Consequently, two-stroke engine designs have found favor in applications such as motorcycles, marine engines, and in yard and garden tools. Extraction of mechanical power from a dual-head cylinder of internal combustion engine conventionally requires the piston to be connected to a connecting rod or another part that moves through an opening in one of the cylinder heads. This creates two difficult problems: (a) sealing of the head at this opening so that the seal would withstand high pressure of hot gas created in the combustion process while, at the same time, allowing the connecting rod to move through the sealed opening; and (b) prevention of an accelerated corrosion of the connecting rod and joints exposed to a very hot corrosive exhaust gas. To date, no practical solutions of these problems have been offered. These problems prevent usage of engines with dual-head cylinders in mechanically operated applications such as automobiles, motorcycles, compressors, pumps and garden tools. The present invention offers the way to extract mechanical power from dual-head cylinders while avoiding these problems.

DISCUSSION OF THE RELATED ART

U.S. Pat. No. 2,317,167 for INTERNAL COMBUSTION ENGINE issued Apr. 20, 1943 to Bernard M. Baer shows an engine having a cylinder with a head at each end. A single piston connected to a conventional crankshaft moves within the cylinder. Valves and a sparkplug are disposed at each end of the cylinder, the valves being actuated by a camshaft. A connecting rod is attached to one side of the piston.

U.S. Pat. No. 3,076,440 for FLUID COOLED DOUBLE ACTING PISTONS FOR HIGH TEMPERATURE ENGINES issued Feb. 5, 1963 to Henry M. Arnold teaches a double acting piston suited for actuation by highly super heated steam, the engine being cooled by circulating a cooling agent.

U.S. Pat. No. 5,816,202 for HIGH EFFICIENCY EXPLOSION ENGINE WITH DOUBLE ACTING PISTON issued Oct. 6, 1998 to Gianfranco Montresor discloses a single piston disposed between two explosion chambers wherein auxiliary pistons of a shaft coupled to the piston control the intake of gases to the combustion chamber.

U.S. Pat. No. 5,844,340 for RODLESS CYLINDER DEVICE issued Dec. 1, 1998 to Mitsuo Noda discloses free-moving piston in a cylinder activated by a working fluid. The piston is magnetically coupled with a unit that freely slides on the cylinder. The movement is used for the cylinder lubrication. Unlike in an internal combustion engine, no transfer of power from the free-moving outside unit to external load is mentioned. Neither is there any specific information regarding the magnets or magnetic coupling.

U.S. Pat. No. 7,296,544 for INTERNAL COMBUSTION ENGINE issued Nov. 20, 2007 to Georg Wilhelm Deeke provides a four-stroke internal combustion engine have a cylinder with a single, double acting piston therein. A conventional connecting rod is attached to one side of the piston.

U.S. Pat. No. 7,318,506 for FREE PISTON ENGINE WITH LINEAR POWER GENERATOR SYSTEM issued Jan. 15, 2008 to Vladimir Meic teaches a free moving piston reciprocating in a double-head cylinder. The structure is integrated into a linear power generator. No application as an integral combustion engine is taught and neither are moving parts outside the cylinder or magnetic coupling between any moving parts.

U.S. Pat. No. 7,438,028 for FOUR STROKE ENGINE WITH A FUEL SAVING SLEEVE issued Oct. 21, 2008 to Edward Lawrence Warren discloses a cylinder structure that includes a fuel saving sleeve having projections on one end. A magnetic force is used to keep the fuel saving sleeve at the top of the engine cylinder during the intake and compression strokes. This makes the sleeve act as an air displacer during the intake and compression strokes. The projection transfers the pressure of burning gases on the sleeve to the piston during the expansion stroke.

U.S. Pat. No. 7,721,685 for ROTARY CYLINDRICAL POWER DEVICE issued May 25, 2012 to Jeffrey Page discloses a cylindrical rotary power device that utilizes pairs of connected back-to-back cylinders and pistons, each with its own head. The transfer of power from the piston pairs is via a mechanical link to a crankshaft through an opening between the connected cylinders. No magnetic coupling between any parts of the device is taught or suggested. Neither are free-moving single pistons nor double head cylinders disclosed.

Instead, there are pairs of connected back-to-back pistons and cylinders each with its own head.

German Patent No. DE3921581 (A1) for IC ENGINE WITH DOUBLE ACTING PISTON HAS PISTON—HAS ITS PISTON ROD ATTACHED TO CROSSHEAD issued Oct. 31, 1990 to Guezel Ahmet discloses a cylinder having dual combustion chambers and a single piston moving in the cylinder. A connecting rod passes through a seal in one of the heads.

None of these patents, taken singly, or in any combination are seen to teach or suggest the novel single-cylinder, dual head internal combustion engine of the present invention.

SUMMARY OF THE INVENTION

In accordance with the present invention there is provided a single-cylinder, dual head internal combustion engine wherein in a single, mechanically unconstrained piston moves reciprocally within the cylinder between the two heads. Magnets or ferromagnetic structures in the piston interact with magnets in a sleeve riding on the outside surface of the cylinder to cause synchronous movement of the sleeve. A yoke coupled to the sleeve may be coupled to a conventional crankshaft to convert the reciprocal movement of the sleeve into rotary motion. Multiple single-cylinder, dual head units may be ganged to form multi-cylinder engine configurations.

In one embodiment, the magnets in the sleeve are electromagnets whereby de-energizing the electromagnets decouples the sleeve from the piston, thereby eliminating the need for a mechanical clutch in a power train driven by the novel engine.

It is, therefore, an object of the invention to provide a single-cylinder, dual head internal combustion engine wherein all output power is provided by a sleeve magnetically coupled to the piston of the engine.

It is another object of the invention to provide a single-cylinder, dual head internal combustion engine wherein magnets or ferromagnetic structures are provided in the engine piston, magnetic structures are provided in the cylinder wall, and magnets are provides in an external sleeve to magnetically couple the sleeve to the piston.

It is a further object of the invention to provide a single-cylinder, dual head internal combustion engine wherein a connecting rod or yoke is attached between the sleeve and a crankshaft.

It is a still further object of the invention to provide a single-cylinder, dual head internal combustion engine wherein such multiple single-cylinder, dual head units may be ganged into multi-cylinder internal combustion engine.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
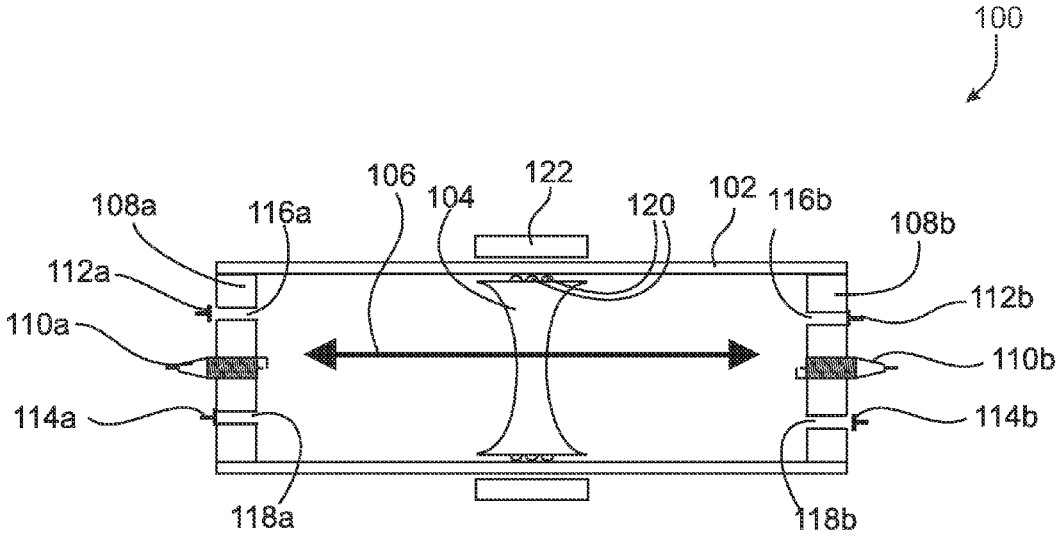
FIG. 1 is a side elevational, cross-sectional, schematic view of the cylinder of the internal combustion engine of the invention.

The present invention provides a single-cylinder, dual head internal combustion engine. A single piston runs in the cylinder, reciprocal piston motion being generated by alternating firing of the combustion chambers formed at each end of the cylinder. There is no connecting rod or any other mechanism coupled directly to the piston. Rather, the piston is magnetically coupled to a sleeve surrounding the cylinder such that the external sleeve moves synchronously with the piston. As discussed in detail hereinbelow, a connecting yoke or other mechanism may be connected between the sleeve and a conventional crankshaft arrangement.

Two-stroke engines typically have two important advantages over four-stroke engines as they are generally simpler and lighter than four-stroke engines. In addition, two-stroke engines typically producing more power for a given cylinder displacement. However, two-stroke engines have several disadvantages when compared to four-stroke engines.

First, two-stroke engines don't last nearly as long as four-stroke engines. The lack of a dedicated lubrication system means that the parts of a two-stroke engine typically wear a lot faster.

Operating costs may be higher as two-stroke oil is expensive, and typically about four ounces of such oil per gallon of gas is required. It has been estimated that a car using a two-stroke engine would burn about a gallon of two-stroke oil every 1,000 miles.

Two-stroke engines are less fuel efficient than four-stroke engines.

Finally, two-stroke engines are heavy polluters. So much, in fact, that it is likely that fewer and fewer two-stroke engines will be used in the future. The pollution comes from two sources. The first is the combustion of the oil. The oil makes all two-stroke engines smoky to some extent, and a badly worn two-stroke engine can emit huge clouds of oily smoke. The second reason is the scavenging process (i.e., cross flow during the intake and exhaust phases: each time a new charge of air/fuel is loaded into the combustion chamber, part of it leaks out through the exhaust port). That accounts for the sheen of oil often seen around any two-stroke boat motor. Any leaking hydrocarbons from the fresh fuel combined with any leaking oil are also harmful to the environment.

These disadvantages now dictate that two-stroke engines are used only in applications either where the engine is used infrequently and/or where a very high power-to-weight ratio is important.

The single-cylinder two-head internal combustion engine of the present invention might technically be viewed as a two-stroke engine because two up and down motions of the piston (i.e., two complete revolutions of the crankshaft), results in two full power cycles (i.e., intake, compression, ignition/combustion, and exhaust). In other words, one complete combustion cycle is completed for each revolution of the crankshaft the same as in two-stroke engines and unlike conventional four-stroke engines that require two revolutions of the crank shaft to complete a combustion cycle. This is possible because the novel design of the internal combustion engine has two separate combustion chambers within the single cylinder. Consequently, while the intake cycle is occurring in the first combustion chambers, the exhaust cycle is occurring simultaneously in the opposite combustion chamber. Likewise, while compression is occurring in the first combustion chamber, intake is occurring in the opposite combustion chamber, etc. Consequently, for each revolution of the crankshaft, all four steps (i.e., intake, compression, combustion, and exhaust) portions have occurred. Therefore, the novel design allows a power (i.e. combustion) cycle for each revolution of the crankshaft instead of a power cycle once every two revolutions of the crankshaft. Consequently, the engine of the proposed novel design has much higher power-to-displacement and power-to-weight ratios than a conventional four-stroke internal combustion engine while maintaining the well-known benefits thereof. The novel engine provides many of the benefits heretofore only found in two-stroke engines while eliminating the two-stroke engine shortcomings (i.e., low fuel efficiency, high pollution, and extensive wear).

Referring first to FIG. 1, there is shown a greatly simplified schematic diagram of a single-cylinder, dual head internal combustion engine in accordance with the invention, generally at reference number 100.

A hollow cylinder 102 houses a piston 104 that may move back and forth therein as shown by arrow 106. Piston 104 is shown with conventional piston rings 120.

Heads 108*a*, 108*b* are disposed at opposite ends of cylinder 102. Each head 108*a*, 108*b* contains a pair of valve ports 116*a*, 116*b*, 118*a*, 118*b*, respectively with associated valves 112*a*, 112*b*, 114*a*, 114*b*, all shown schematically.

It will be recognized by those of skill in the art that in conventional four-stroke engines, intake and exhaust valves are implemented as spring loaded structure sealing against valve seats in the engine's head. Rocker arms force the valves open when the arms are activated by push rods riding on a cam shaft. Such an arrangement is not possible for the present engine, because the camshaft would have to be driven by the sleeve that does not necessarily closely follows the piston (for instance, when the engine is started and under hard acceleration). Instead, the timing of valve operation shall be related to the position and speed of the piston. This can be accomplished by using electromagnetically actuated valves as described hereinbelow.

Figure 6:
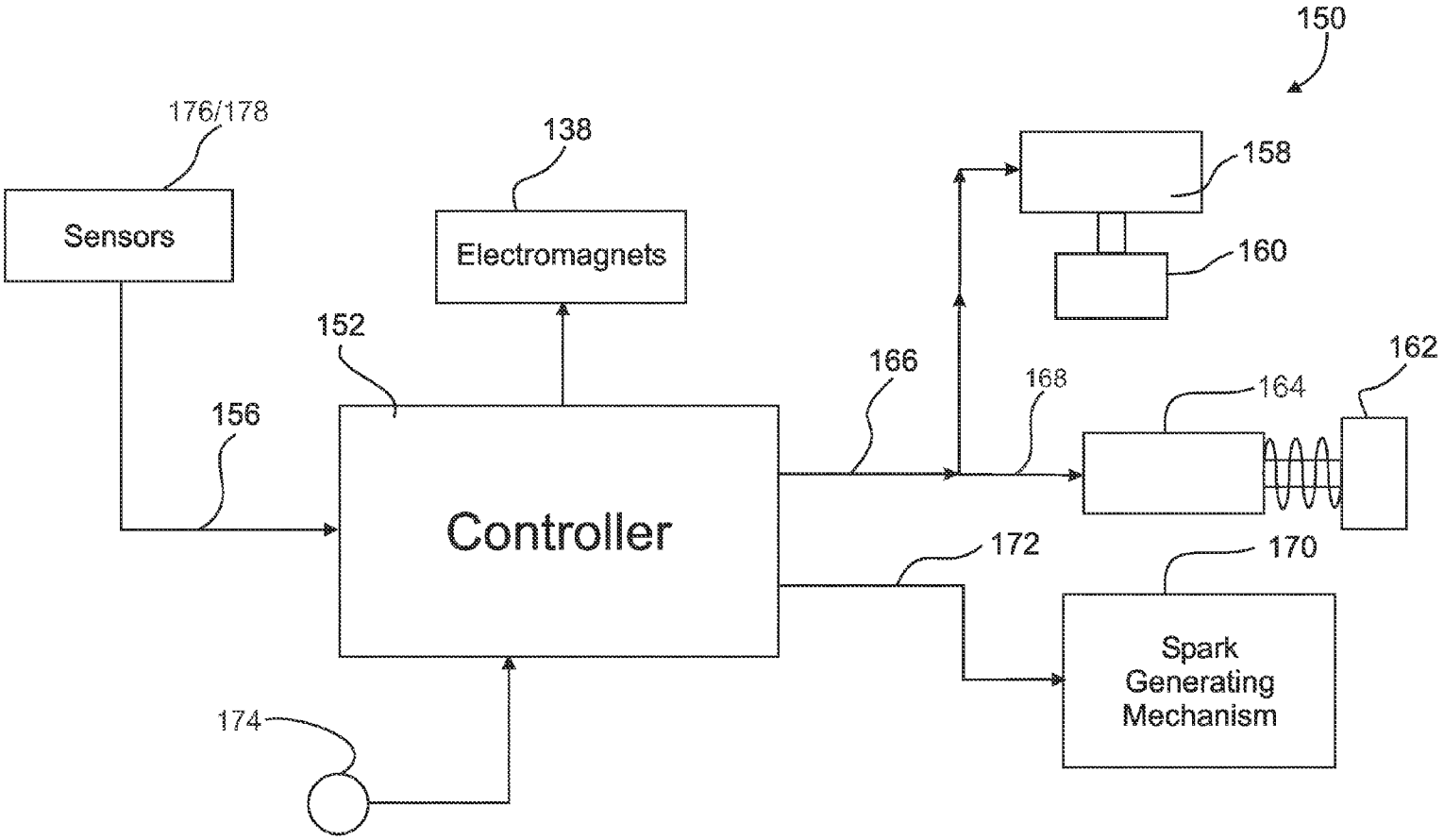
FIG. 6 is a simplified system block diagram of a control system suitable for use with the internal combustion engine of the invention.
Figure 7A:
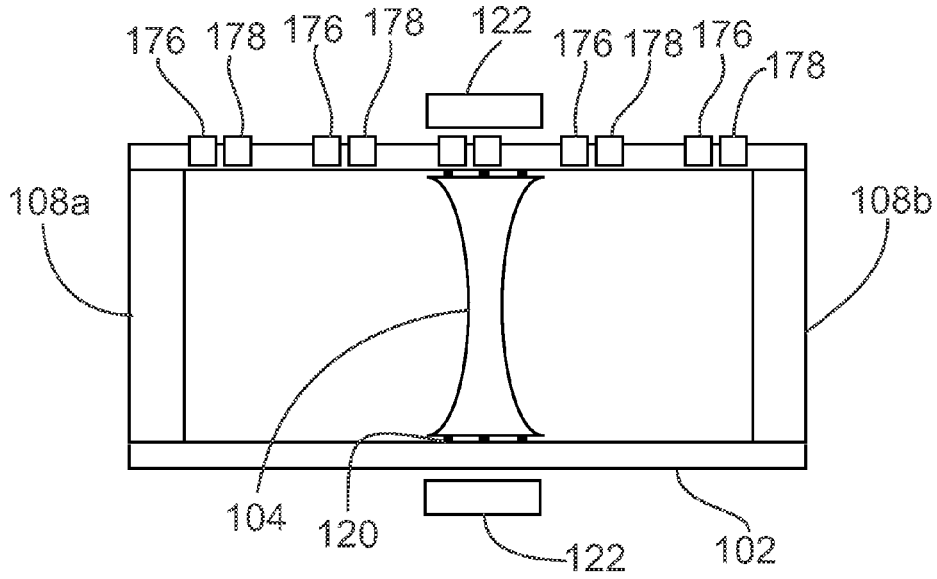
FIGS. 7A and 7B are side elevational, cross-sectional, and end elevational, schematic views, respectively of an engine configuration having all sensors on a single side of the cylinder.
Figure 7B:
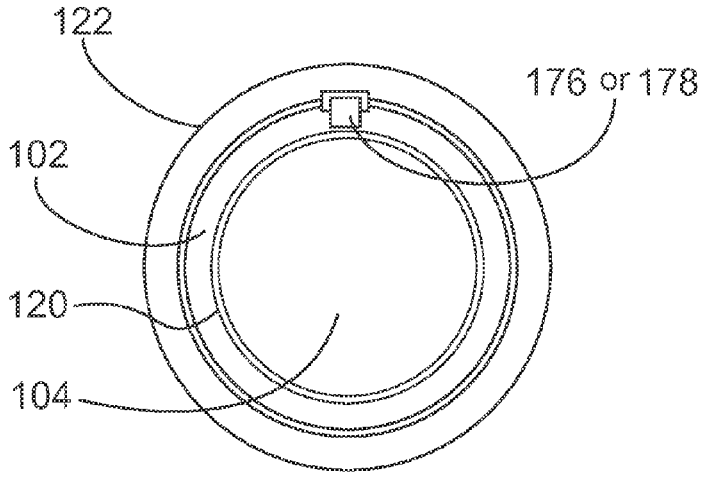
Figure 7C:
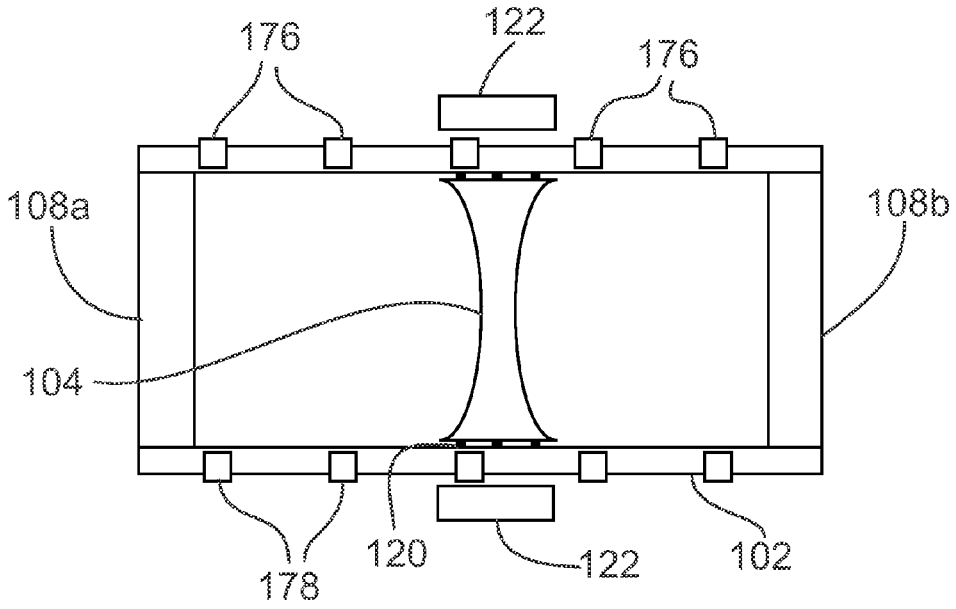
FIGS. 7C and 7D are side elevational, cross-sectional, and end elevational, schematic views, respectively of an engine configuration having the sensors diametrically disposed on two sides of the cylinder.
Figure 7D:
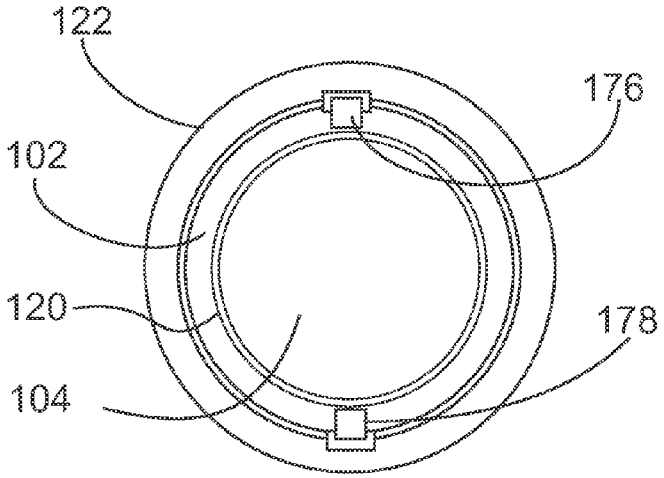

Referring now also to FIG. 7A-7D, there are shown side elevational (FIGS. 7A and 7C and end elevational (FIGS. 7B and 7D) schematic representations of two embodiments of piston, cylinder, sleeve and two sets of sensors 176, 178 detecting position of the piston and the sleeve, respectively. Sensors 176, 178 may be magnetic proximity sensors or any other appropriate sensors of types believed to be well known to those of skill in the art. First, piston position sensors 176 are discussed. An array of such sensors 176 is installed in the cylinder 102 wall parallel to its axis. Each sensor 176 is installed in a special recess, not specifically identified, in the outer surface (i.e., facing the sleeve) of the piston 104. The recesses do not penetrate the cylinder 104 wall all the way to the inner space, not specifically identified, of the cylinder 102, (i.e., the inner surface of the cylinder 102 remains untouched). The bottom of each recess is as close to the inner surface of piston 104 as practically possible in order to ensure an accurate detection of the piston 104 position. The sleeve 122 has a grove above the array of the sensors in order to accommodate the wires, not shown, that connect the sensors to a controller 152 best seen in FIG. 6.

As the piston 104 approaches one of the sensors 176, the sensor 176 generates a signal that is sent to the controller 152. Based on the time passed between the signals from two adjacent sensors 176, the controller 152 calculates the speed of the piston 104 and its position at any moment until the piston 104 reaches the next sensor 176 and then this process is repeated. Thus, the position and speed of piston 104 are known for every moment of its movement. Based on this information and other parameters the controller 152 generates properly timed signals to actuate the intake and exhaust valves 112*a*, 112*b*, 114*a*, 114*b*.

The controller could readily generate timing signals for spark generation. The necessary sensor technology for generating input signals as well as controller circuitry are both believed to be well known to those of skill in the art and, consequently, neither is further discussed herein.

One style of electromagnetically actuated valve may be implemented as an electrically-actuated solenoid configured to open conventional spring loaded valves.

In another embodiment of electrically actuated type of valve is a rotary valve. A rotary solenoid, stepper motor or other such actuator is used to selectively uncover and cover a valve port 116*a*, 116*b*, 116*a*, 116*b* at an appropriate time.

Another possible implementation of an exhaust valve is as a pressure relief valve that opens when the exhaust gas in one of the combustion chamber reaches a predetermined pressure. A mechanism for delaying the closing of the valve may also be provided to avoid trapping exhaust gases in the cylinder when the pressure actuated valve suddenly closes as soon as the pressure drops below the valve activation level.

It is envisioned that hybrid valve actuation systems combining two or more of the disclosed valve actuation technologies may be both useful and readily implementable.

Spark plugs 110*a*, 110*b* are disposed in respective heads 108*a*, 108*b*. An electrical system including a timing mechanism may be used to provide a high voltage current to fire sparkplugs 110*a*, 110*b*.

In alternate embodiments of the novel engine of the invention, a magneto mechanism such as those used in some two-stroke engines may be used to provide the high voltage for firing sparkplugs 110*a*, 110*b*. Such ignition systems are believed to be well known to those of skill in the internal combustion engine art. Consequently, the ignition system required to make internal combustion engine 100 functional is not further discussed or described herein.

Figure 4:
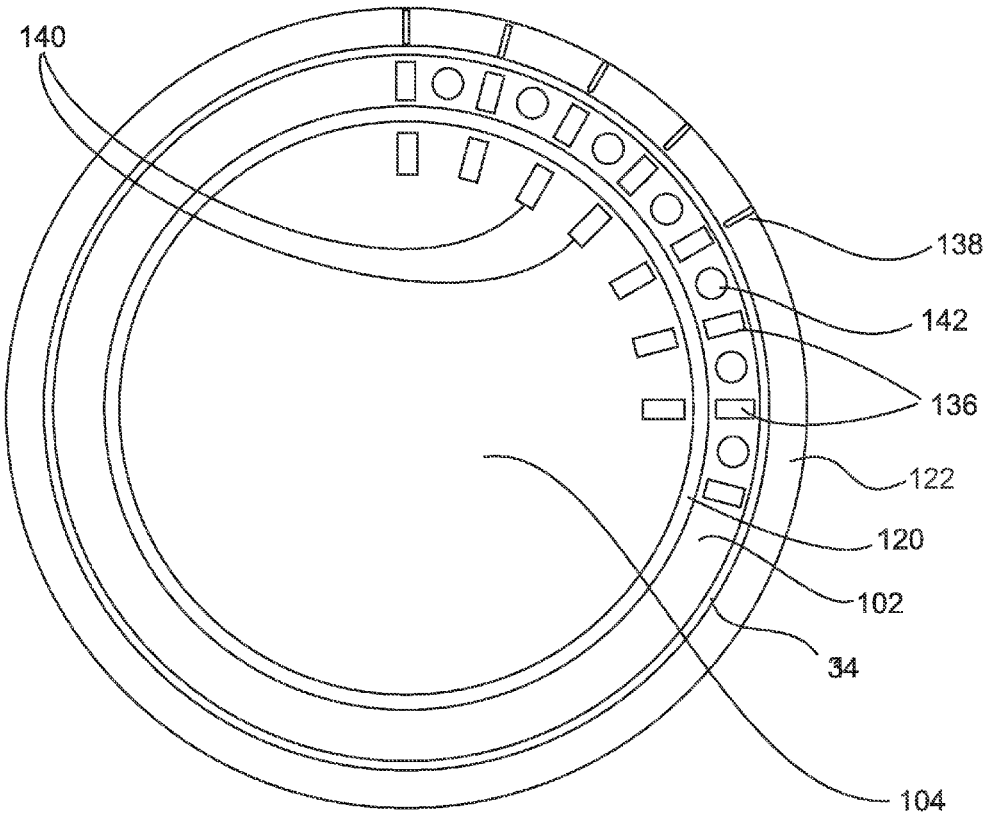
FIG. 4 is an end elevational, cross-sectional, schematic view of the internal combustion engine of FIG. 1 showing the embedded magnetic coupling and cooling components.

A sleeve 122 of slightly larger diameter than an external diameter of cylinder 102 shown disposed concentrically around cylinder 102. However, for reasons of clarity, no magnetic coupling elements are shown in FIG. 1. The magnetic coupling elements are shown in FIG. 4 and are described in detail hereinbelow. Sleeve 122 is free to slide reciprocally along an outer surface of cylinder 102.

Figure 2A:
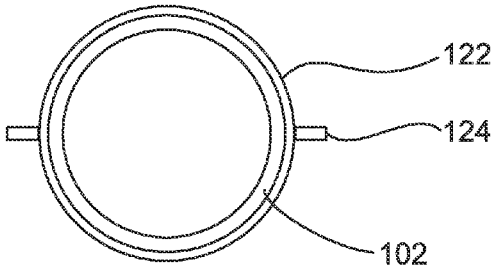
FIG. 2A is an end elevational schematic representation of the cylinder and sleeve of the internal combustion of FIG. 1.

Referring now also to FIG. 2A, there is shown an end-elevational schematic view of engine 100 of FIG. 1 showing the relationship of sleeve 122 to cylinder 102. Yoke connecting points 124 are diametrically disposed on sleeve 122.

Figure 2B:
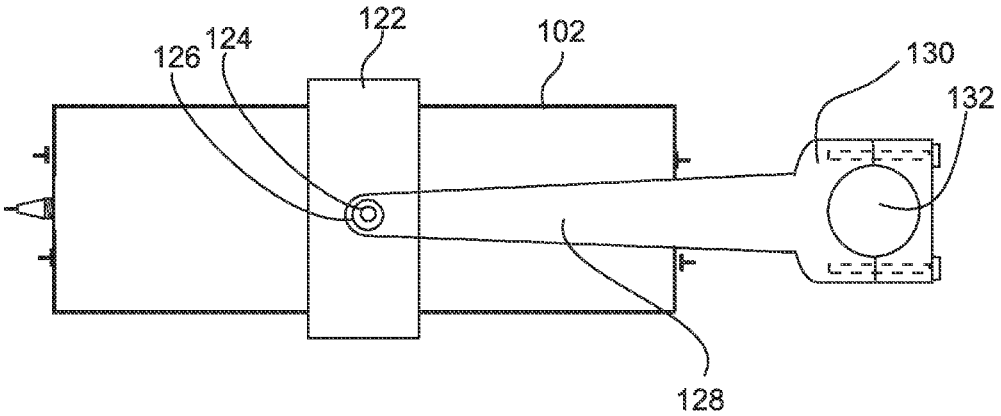
FIG. 2B is a side elevational, schematic view of the internal combustion engine of FIG. 1 showing a first embodiment of a connecting rod arrangement.

Referring now also to FIG. 2B, there is shown a side elevational, schematic view of engine 100 but with a pair of connecting rods 128 (only one visible in FIG. 2B), each having a proximal end, not specifically identified, rotatively attached to sleeve 122 via yoke connecting point 124 and an intervening bearing 126. A distal end of each connecting rod 128 is connected to a crankshaft 132 through crankshaft bearings 130.

Figure 2C:
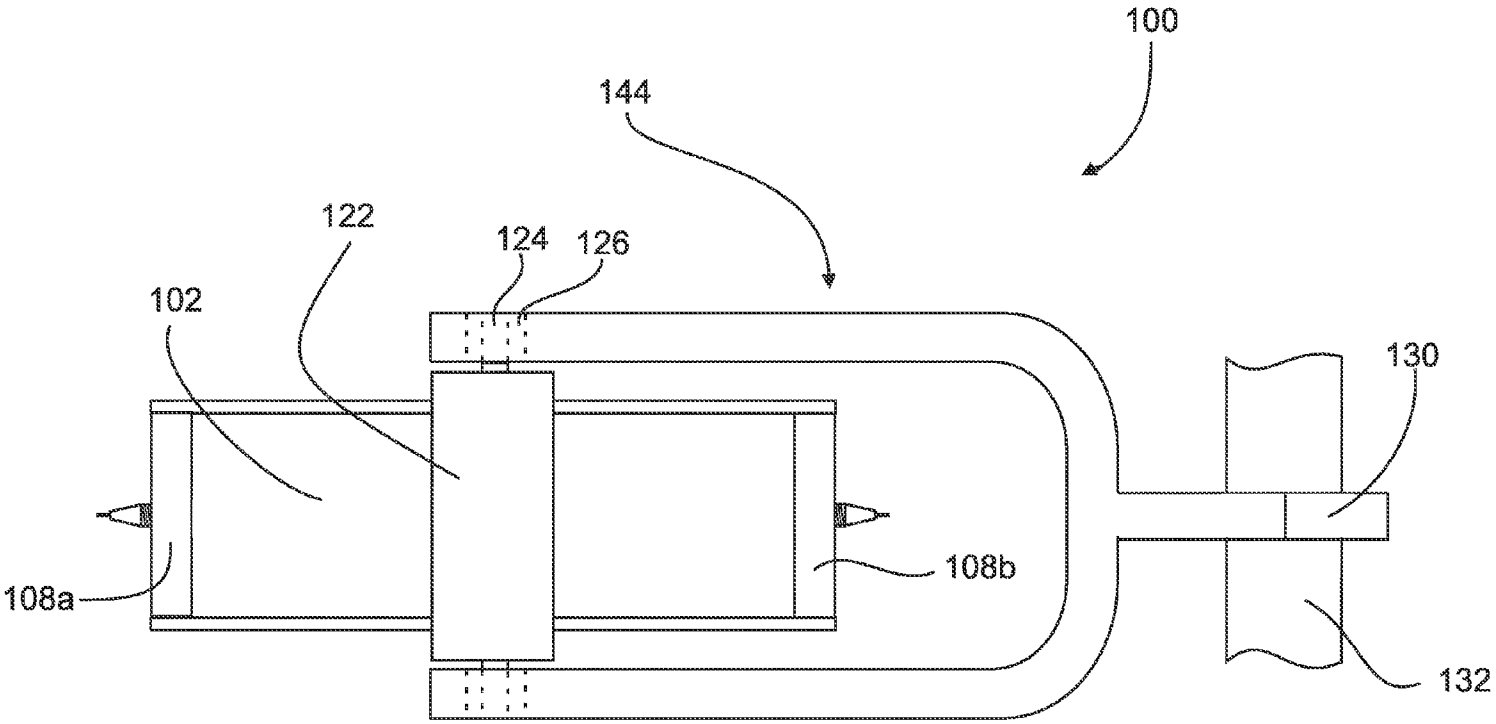
FIG. 2C is a top plan, schematic view of a connecting yoke arrangement suitable for use with the internal combustion engine of FIG. 1.

Referring now also to FIG. 2C, there is shown an alternate embodiment of a mechanism for connecting sleeve 122 with crankshaft 132. Yoke 144 has a U-shaped portion that straddles sleeve 122. The proximal ends of both sides of the U-shaped portion are connected to respective ones of yoke connecting points 124 through yoke to sleeve bearing 126. A distal end of yoke 144 is connected to crankshaft 132 through crankshaft bearing 130.

In conventional engines, lubrication is provided by oil "splashed" onto the cylinder wall from the crankcase by the connecting rods. In the novel engine 100 of the invention, an alternate way of providing cylinder lubrication must be provided. One way is to directly inject oil into the cylinder through one or more injection ports. A second alternative is to mix oil with the fuel (i.e. gasoline) as is common practice in two-stroke engines. While either injecting oil or adding oil to the fuel could probably supply adequate lubrication, direct oil injection would probably be more effective as less oil would be in the mixture and more directly deposited onto the surfaces.

However, friction and thus the amount of required lubricant may be reduced by forming cylinder 102 from a ceramic material, especially a "self-lubricating" ceramic composite. Such ceramic composites include, for example, an Alumina-graphite composite, a Silicon nitride-graphite composite, or an Alumina-$CaF_2$ composite. These composites can withstand high operating temperatures (e.g., 750-1750° F. (400-950° C.)). Other such materials may be known to other persons of skill in the art and the invention is not considered limited to the ceramic materials chosen for purposes of disclosure. Rather, the invention is intended to include any other suitable ceramic materials in addition to those chosen for purposes of disclosure.

Ceramics inherently less prone to mechanical wear, then metals. In addition, the solid lubricant components in the composites (graphite, CaF2, etc.) greatly reduce the friction. These materials can be used for fabricating piston 104 and/or cylinder 102 or for coating the surface of one or both thereof.

In addition to cylinder wall lubrication, lubrication must also be provided for sleeve 122 as is slides on an exterior surface of cylinder 102. It is believed that implementing the requisite lubrications system is well within the capabilities of a person of average skill in the art. Consequently, lubrication systems are not further discussed herein.

It will be recognized that additional mechanisms are required, at a minimum for example, one or more valve actuation mechanisms, intake and exhaust manifolds, a fuel source as well as a timed spark source to make a functioning internal combustion engine.

Referring now also to FIGS. 3A-3D, there are shown progressive schematic diagrams illustrating the combustion cycle of the engine 100. For simplicity and diagram clarity, reference numbers are not generally shown on FIGS. 3B-3D.

Figures 3A, 3B, 3C, 3D:
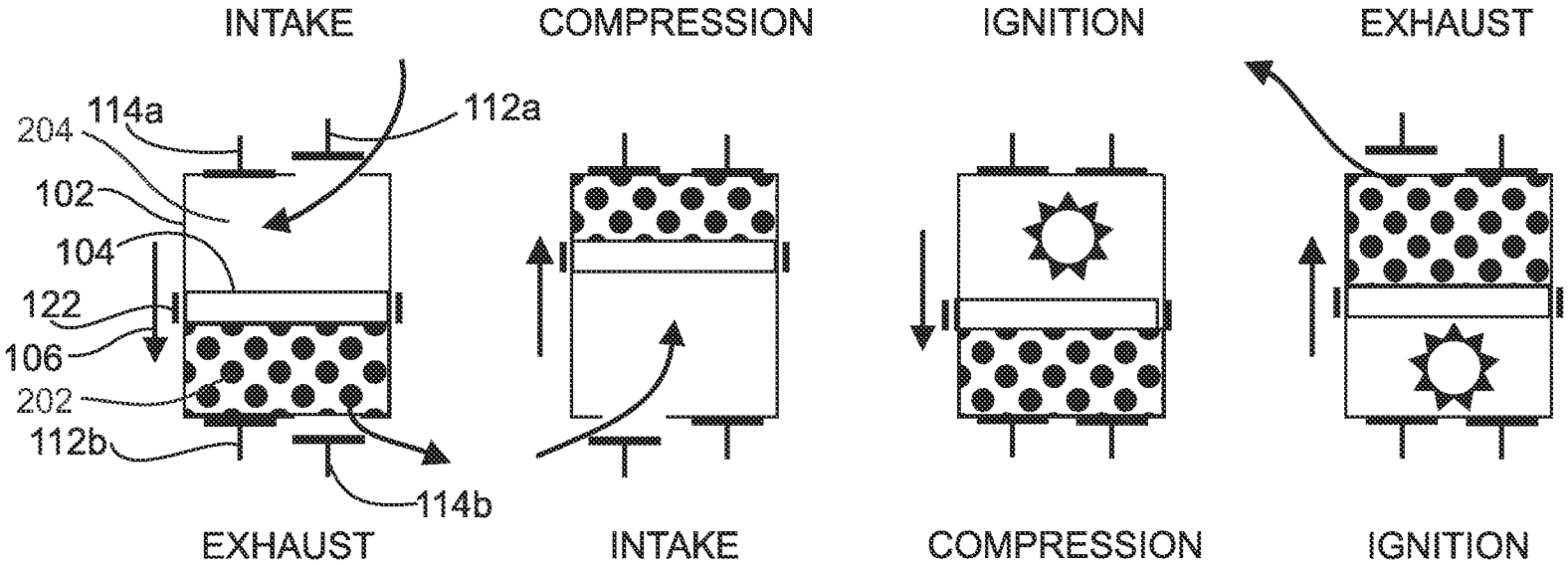
FIGS. 3A-3D are schematic representations of the stages of the combustion cycle of the internal combustion engine of FIG. 1.

In FIG. 3A, the piston 104 is moving in a downward direction, exhausting spent gas 202 from the lower combustion chamber through exhaust valve 114*b*. Simultaneously, fresh air/fuel mixture 204 is being brought into the upper combustion chamber through intake valve 112*a*.

In FIG. 3B, both exhaust valve 114*b* and intake valve 112*a* are closed, Piston 104 is moving upward thereby compressing the air/fuel mixture in the upper combustion chamber while drawing air/fuel mixture 204 into the lower combustion chamber through intake valve 112*b*.

In FIG. 3C, intake valve 114*b* is now closed and the compressed air/fuel mixture in the upper combustion chamber is ignited by spark plug 110*a*. The resulting explosion forces piston 104 downward, thereby compressing the air/fuels mixture in the lower combustion chamber.

In FIG. 3D, the piston 104 is again moving upward responsive to the ignition of the compressed air/fuel mixture in the lower combustion chamber. The movement of the piston thereby exhausts the contents of the upper combustion chamber through open exhaust valve 114*a*.

This sequence is then repeated.

Referring now also to FIG. 4, there is shown an end elevational, cross-sectional, schematic view of the cylinder and sleeve of engine 100. One of the novel features of internal combustion engine 100 is the unique arrangement of magnets and ferromagnetic structures (e.g., 140, 136, 138) that couple sleeve 122 to piston 104.

In FIG. 4, piston 104 is shown having magnets 140 embedded therein. The magnets are polarized radially, (i.e., in the direction perpendicular to the axis of the piston). The magnets are embedded in such a way that surface of one of the poles of each magnets is, preferably, exposed and flash with the side surface of the piston. Similarly, in case of nonmagnetized ferromagnetic structures, one surface of each structure shall be, preferably, exposed and flash with the side surface of the piston. This reduces the magnetic gap between the piston and sleeve thus increasing the strength of the magnetic coupling between the piston and sleeve. The piston magnets or ferromagnetic structures do not touch each other and are separated from each other by a nonmagnetic material the piston is made of. The magnets or ferromagnetic structures may be distributed over either the entire side surface of the piston or just a part of it, depending on the required strength of the magnetic coupling between the piston and sleeve and other factors.

Magnets 140 may be rare earth magnets, ceramic magnets, or other high-strength magnets know to those of skill in the magnetic arts. As Piston 104 will typically operate at a high temperature, magnets 140 need to be designed to operate at such temperatures without losing any significant portion of their magnetism. Ultra high temperature magnets are believed to be well known. For example, in the 1970s, Samarium Cobalt magnets were first formulated. These SmCo5 and Sm2Co17 magnets may be used at temperatures in excess of 300° C. "In about 1995, Electron Energy Corporation (EEC) began developing a new class of Sm2Co17 magnets for use at even higher temperatures. As a result, the following materials were developed: EEC24-T400, EEC20-T500 and EEC16-T550 for use at temperatures of up to 400, 500 and 550° C., respectively. It is believed that such magnets are suitable for the application. As other ultra high temperature magnets may be known to those of skill in the art, any other such suitable magnets may be used to replace the Samarium Cobalt magnets chosen for purposes of disclosure. Consequently, the invention is intended to include other suitable magnets in addition to the disclosed Samarium Cobalt magnets.

In still other embodiments, magnets 140 may be replaced with pieces of non-magnetized ferromagnetic materials. Such material may include but are not considered limited to soft iron, MuMmetal®, or other such materials. The use of non-magnetized ferromagnetic materials overcomes the possibility of magnets 140, even when made from ultrahigh temperature magnetic material (e.g., SmCo5 or Sm2Co17) from demagnetizing over time from exposure to the high temperatures experiences in piston 102.

Cylinder 102 and piston 104 are typically formed from a non-ferromagnetic material, for example, Aluminum, an Aluminum alloy, or ceramic, such as Alumina ($Al_2O_3$), or any other suitable high-temperature ceramic, including "self-lubricating" types. Because cylinder 120 must have significant strength and stiffness to perform its intended function, it is anticipated that it must be designed with a relatively thick wall. "Thick walls could significantly reduce the strength of the magnetic coupling between piston 104 and sleeve 122. To overcome the magnetic gap created by the wall thickness of the cylinder 102 wall, ferromagnetic structures 136 or non-magnetized structures, not specifically identified, may be embedded within the wall of cylinder 102. Surfaces of these ferromagnetic structures that face the space between the piston 104 and cylinder 102 and surfaces that face the space between the cylinder 102 and sleeve 122, are, preferably, exposed and flush with the cylinder 102 surfaces in order to minimize the gap between the ferromagnetic structures 136 of the cylinder 102 and the magnetic elements, 140, 138 of the piston 104 and sleeve 122, respectively. This arrangement ensures a maximal possible strength of the magnetic coupling between the piston 102 and sleeve 122. The ferromagnetic structures do not touch each other and are separated from each other by the nonmagnetic material of which cylinder 102 is made. Ferromagnetic structures 136 are typically formed from a highly magnetically conductive material such as iron, Permalloy or Mu Metal® (also known as mumetal, MuMETAL, etc). The trademark on the term Permalloy has now expired. Mu Metal is the trademark of Magnetic Shield Corporation of Bensenville, Ill., USA. These materials are typically alloys of nickel and iron. Usually other elements such as copper, chromium and/or molybdenum are also found in such alloys. These materials are notable for their high magnetic permeability.

These ferromagnetic structures 136 convey magnetic flux between magnets or electromagnets 138 embedded in sleeve 122 and magnets or ferromagnetic structures 140 embedded in piston 104. The sleeve magnets are polarized radially and the cores of electromagnets are oriented radially, (i.e., in the direction, perpendicular to the axis of the sleeve) The surfaces of the magnets and of the cores of electromagnets that face the cylinder are, preferably, exposed and flash with the inner surface of the sleeve. This arrangement ensures a maximal strength of the magnetic coupling between the magnets in the sleeve and magnets or ferromagnetic structures in the piston. The sleeve magnets do not touch each other and are separated by the nonmagnetic material from which sleeve is made.

The magnetic attraction between sleeve magnets or electromagnets 138 and the piston magnets or ferromagnetic structures 140 couple piston 104 to sleeve 122 so that sleeve moves reciprocally along the outer surface of cylinder 102 synchronously with piston 104. Implementing magnets 138 as electromagnets may be useful to create a strong enough magnetic attraction to ensure that sleeve 122 remains coupled to piston 104 even when engine 100 is under load. As the movement of sleeve 122 is relatively small, providing power to electromagnets 138 using a flexible cable, not shown, connecting electromagnets 138 to an external power source, not shown is believed to be easily implementable. In other embodiments, sliding electrical contacts may be used to provide electrical power to electromagnets 138. Other ways of providing power to electromagnets 138 will be known to persons of skill in the art. Consequently, the invention is not considered limited to any particular method or mechanism for connecting electromagnets 138 to a power source. Rather, the invention is intended to include any method or mechanism for providing power to electromagnets 138.

By using electromagnets 138 in the sleeve 122 it is possible to switch on and off the magnetic attraction between the sleeve 122 and piston 104. The ability to do so is important, since the attraction between the piston 104 and the sleeve 122 is needed only when all three of the following conditions exist:

(a) the piston 104 and sleeve 122 move in the same direction;

(b) the piston 104 is slightly ahead of the sleeve 122; and (c) the piston 104 is performing a power stroke (i.e. pushed by the pressure of the ignited fuel/air mixture 204).

Since the sleeve 122 does not always closely follow the piston 104 (for instance, when the engine 100 is started and/or when under hard acceleration), the relative position of the piston 104 and sleeve 122 and their speeds must be constantly monitored and processed by the controller 152, best seen in FIG. 6, to verify existence of the aforementioned three conditions. When such conditions happen, the controller 152 sends a signal to activate the sleeve electromagnets 138, (i.e., the controller 152 switches on the magnetic attraction between the piston 104 and sleeve 122). As soon as at least one of these three conditions ceases to exist, the controller 152 sends a signal to deactivate the electromagnets 138, and so on. Monitoring of the relative position and speeds of the piston 104 and sleeve 122 is done by using proximity sensors 176, 178, respectively. The array of such sensors 176, 178 that monitor position of the sleeve 122 is installed in the wall of cylinder 104 the same manner as it is done with the proximity sensors 176 that monitor position of the piston 104 as previously discussed. The sleeve sensors 178 may be installed either in line with the piston sensors 176 or in a separate line on the opposite side of the piston 104.

Using signals from the sensors 176,178, the relative position and speeds of the piston 104 and sleeve 122 are determined as follows:

(a) the direction of movement of the piston 104 and sleeve 122 may be determined by the controller 152 based on time passed between two consecutive signals from two adjacent piston sensors 176 and time passed between two consecutive signals from two adjacent sleeve sensors 178;

(b) the relative position of the piston 104 and sleeve 122 may be determined by the controller 152 based on two latest signals—one from a piston proximity sensor 176 and the other from a sleeve proximity sensor 178; and, (c) the type of piston stroke (i.e., determination whether the piston 104 is in the power stroke or not can be made based on the last signal received from the spark generator 170, best seen in FIG. 6, and the number of signals received from the piston sensors 176 after the last signal generated by spark generator 170).

The complete and detailed logic of processing signals generated by the piston and sleeve sensors 176, 178 are believed to readily devisable by a person of ordinary skills in the art of engine controllers when the types and locations of the sensors 176, 178 are known. Consequently, such detailed timing information is neither disclosed nor further discussed herein.

Additional functionality may be provided by an electromagnet implementation of sleeve magnets 138. By removing power from magnets 138 (now assumed to be electromagnets) so that sleeve 122 may be decoupled from piston 104, any need for a mechanical clutch eliminated.

In conventional engines, cylinders are typically cooled by large external fins on the outside of the cylinders (e.g., motorcycle engines). In most current automotive engines, a water jacket surrounds the cylinder(s) with a cooling liquid that is circulated through the water jacket. A radiator or other heat exchange mechanism cools the circulating liquid.

Because connecting rods 128 or yoke 144 are disposed on the outside of cylinder 102, neither of such prior art cooling solutions are practical. However, cooling conduits or tubes 142 may be disposed within the cylinder 102 wall. A cooling fluid (i.e., a liquid or gas) may be circulated through conduits 142 to cool cylinder 102 and piston 104. The design of an external system to provide a cooling fluid to conduits 142 and to exchange heat from cylinder 102 is believed to be easily within the abilities of a person of average skill in the engine arts. Consequently, an external cooling system for internal combustion engine 100 is not further described or discussed herein.

It may be necessary to provide a mechanism for retarding or stopping movement of piston 102 as it approaches heads 108*a*, 108*b*. Such a mechanism could be implemented mechanically using springs, not shown. As piston 104 approaches one of heads 108*a*, 108*b* it may contact a spring, not shown disposed within cylinder 102. As the piston 104 continues its travel towards head 108*a* or 108*b*, the spring will be compressed by the piston 104 so that the kinetic energy of piston 104 is absorbed. The size and strength of the spring may be chosen to provide the desired retardation of piston 104.

In alternate embodiments, an electromagnetic retardation system may also be implemented. The electromagnetic retardation system operates similarly to electromagnetic brakes utilized in high-speed trains. The principle of their operation can be demonstrated by the following example: when a nonmagnetic metal plate (such as Aluminum, for instance) is moving fast in the proximity of a magnet perpendicular to the axis of its polarization, eddy currents are generated in the plate. These currents create magnetic field in such a direction that its interaction with the magnetic field of the magnet creates a force resisting to the movement of the plate, (i.e., a retardation force is applied to the plate). The electromagnetic retardation mechanism in the present invention can be executed by installing one or several magnets or electromagnets outside the cylinder, polarized radially with respect to the cylinder axis. When the piston is approaching a cylinder head, the magnets or electromagnets interact with the eddy currents generated in the nonmagnetic metal that piston is made of (for instance, aluminum or its alloys). This interaction results in retardation of the piston. In order to increase the effectiveness of this mechanism, the ferromagnetic cores of the solenoids shall, preferably, partially penetrate the cylinder wall (without penetrating the inner surface of the cylinder) so that the end surface of each core is as close to the approaching piston as practically possible. It will be recognized that no retardations system may be needed. It will be further recognized that many alternate methods or systems may be used to provide piston retardation and/or stopping. Consequently, the invention is not considered limited to the two examples of piston 104 retardation system chosen for purposes of disclosure. Rather the invention is intended to encompass any system or method for providing retardation of the movement of piston 104 within cylinder 102.

Figure 5:
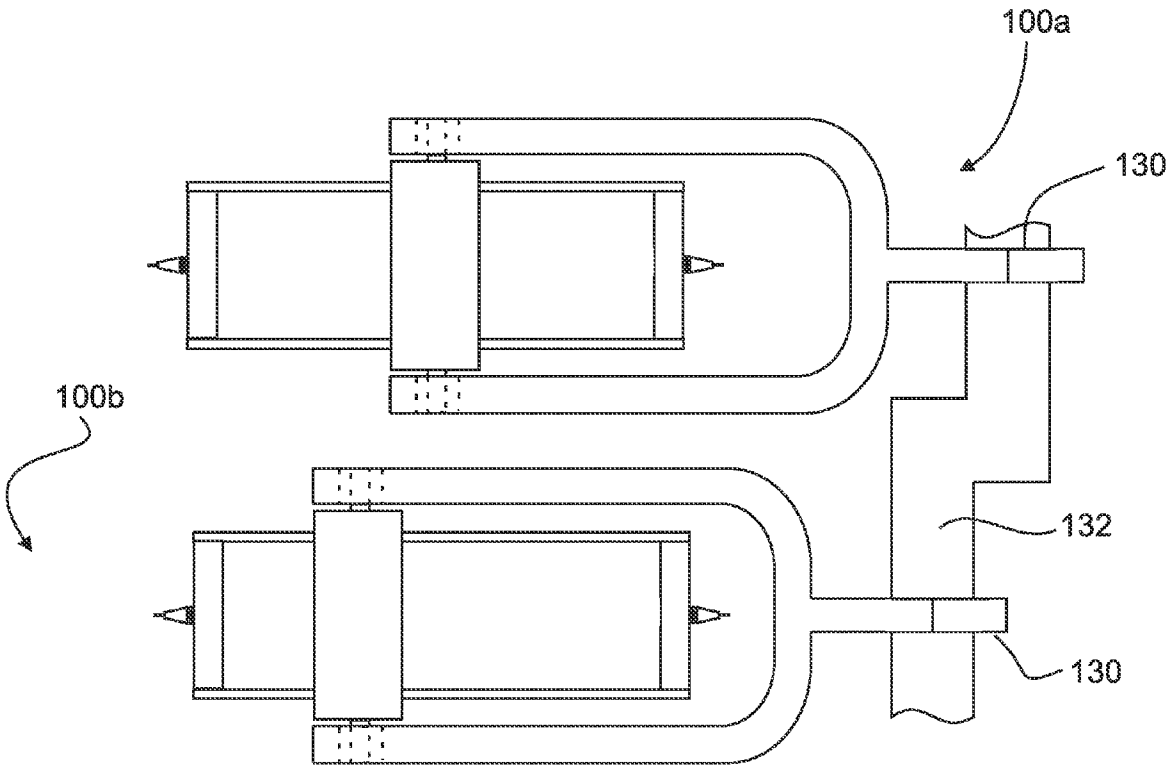
FIG. 5 is a top plan, schematic view of a pair of the engines of FIG. 3C joined into a two-cylinder internal combustion engine.

While a single-cylinder engine has heretofore been disclosed, it is, of course, possible to gang multiple cylinders. Referring now also to FIG. 5, there is shown a simplified top plan, schematic view of a two-cylinder internal combustion engine including a pair of internal combustion engines 100 (labeled reference numbers 100*a*, 100*b*, respectively). All elements remain the same but crankshaft 132 has an offset or "crank" shown therein. It will be recognized that any number of additional "engine" 100 elements may be combined into multi-cylinder engine systems, each element engine 100 being maintained by common support systems supplying air/fuel mixture supply, exhaust removal, spark supply and control systems, etc. Also, while FIG. 5 shows a side-by-side configuration, other physical arrangement of engines 100 are possible. Such arrangements include horizontally opposed, slant arrangements, and radial arrangements.

Referring now also to FIG. 6, there is shown a simplified system block diagram of an electronic controller suitable for use with internal combustion engine 100, generally at reference number 150.

A controller 152 is connected to one or more engine sensors 176, 178 by electrical connection 156.

A rotary valve actuator 158 is shown operatively connected to a rotary valve 160. Optionally, a liner valve actuator 164 is shown operatively connected to a conventional, spring loaded valve 162. Rotary actuator 158 is connected to controller 152 by electrical connection 166. Optional linear actuator 164 is connected to controller 152 by auxiliary electrical connection 168 in combination with electrical connection 166.

A spark generating mechanism 170 is shown connected to controller 152 by electrical connection 172.

A programming input 174 is provided to controller 152.

Controller, specifically process control controllers are believed to be well known to those of skill in the engine control arts. Consequently, no additional description of controller 152 is provided herein—any suitable controller known to those of skill in the art may be utilized.

Sensors 176, 178 may be any combination of optical, magnetic, or physical sensors that generate signals as piston 104 passes a predetermined point or points along cylinder 102. Each of the sensors generates an electrical signal suitable for recognition by controller 152.

Rotary valve actuator 158 may be implemented using a rotary solenoid. A return spring (e.g., a torsion spring), not shown may be used if necessary. In alternate embodiments, a bi-directional rotary solenoid may be used. In still other alternate embodiments, a stepper motor with an appropriate controller embedded in controller 152 may be used to actuate rotary valve 160.

Optionally, a linear actuator 164 may be used to open a conventional spring loaded valve.

Spark generating mechanisms 170 are also believed to be well known to those of skill in the art. It will be recognized that controller 152 provides necessary spark timing and advance function based upon input from sensors 176, 178.

It will be recognized that four valve actuators and spark signals for two spark plugs are required for a single-cylinder version of the internal combustion engine of the invention. When multiple cylinders are combined, it will be recognized that controller 152 is required to generate appropriate control outputs to control at least four valves and two spark plugs per cylinder.

Further, controller 152 can provide control of electromagnets 138 both for selectively powering electromagnets 138 as required in order to synchronize the movements of the sleeve and piston and for disconnecting the sleeve from the piston when a clutch function is required.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A single-cylinder, dual head internal combustion engine, comprising:

a) a hollow cylinder having a cylinder wall formed from a non-magnetic material, an outside major surface, a major axis, a proximal end, and a distal end, said hollow cylinder having a plurality of nonmagnetized ferromagnetic structures embedded therein, said embedded non-magnetized ferromagnetic structures being disposed radially and circumferentially around said cylinder wall and each having a first end disposed proximate an outside surface of said cylinder wall and a second end disposed proximate an inside surface of said cylinder wall, each of said plurality of ferromagnetic structures being spaced apart from one another and separated by said non-magnetic material of said cylinder wall;

b) a cylindrical piston having a side outer surface, said cylindrical piston being disposed within said hollow cylinder and free to move reciprocally along said major axis, said cylindrical piston having a plurality of ferromagnetic structures radially and circumferentially embedded in said piston, said ferromagnetic structures have a surface disposed proximate said side outer surface;

c) a pair of heads, one of said pair of heads sealing said proximal end of said cylinder, another of said pair of heads sealing said distal end of said cylinder;

d) a sleeve having an outer surface and a smooth inner surface disposed circumferentially around said outside major surface of said cylinder with said smooth inner surface in direct contact with said outside major surface, said sleeve being free to move reciprocally therealong, said sleeve having a plurality of sleeve magnets embedded therein and a pair of diametrically opposed, outwardly protruding yoke connection points diametrically disposed on an outer surface thereof;

whereby magnetic attraction couples said sleeve to said piston such that said sleeve moves substantially synchronously with said piston.

2. The single-cylinder, dual head internal combustion engine as recited in claim 1, wherein said ferromagnetic structures embedded within said piston comprise at least one of the classes of ferromagnetic structures chosen from the group: magnetized ferromagnetic structures and non-magnetized ferromagnetic structures.

3. The single-cylinder, dual head internal combustion engine as recited in claim 2, wherein said class of magnetized ferromagnetic structures comprises high temperature magnets selected from the group: SmCo magnets, FeCoNi magnets, and AlNiCo magnets, and other magnets capable of operating at temperature of at least 300° C.

4. The single-cylinder, dual head internal combustion engine as recited in claim 2, wherein said class of non-magnetized ferromagnetic structures comprises soft iron, an iron-nickel alloy, and an iron-nickel alloy comprising at least one of the elements chosen from the group: copper, chromium and molybdenum.

5. The single-cylinder, dual head internal combustion engine as recited in claim 2, wherein said class of magnetized ferromagnetic structures comprises at least one selected from the group: SmCo5 magnets, Sm2Co17 magnets, and other magnets capable of operating at temperature of at least 300° C.

6. The single-cylinder, dual head internal combustion engine as recited in claim 1, wherein at least one of said hollow cylinder and said piston is formed from one or more of the materials selected from the group: aluminum, another non-ferrous material, a ceramic, a self-lubricating ceramic, and a non-ferrous material having a coating of self-lubricating ceramic on at least one surface thereof.

7. The single-cylinder, dual head internal combustion engine as recited in claim 1, wherein said plurality of sleeve magnets comprises at least one electromagnet.

8. The single-cylinder, dual head internal combustion engine as recited in claim 1, wherein said pair of yoke attachment points are each adapted to receive and rotatively retain at least one selected from the group: a connecting rod, and a connecting yoke.

9. The single-cylinder, dual head internal combustion engine as recited in claim 8, at least one of said pair of yoke attachment points comprises a bearing.

10. The single-cylinder, dual head internal combustion engine as recited in claim 1, wherein each of said pair of heads disposed respectively at said proximal end and said distal end of said hollow cylinder comprises at least one selected from the group: an intake valve, an exhaust valve, and a sparkplug.

11. The single-cylinder, dual head internal combustion engine as recited in claim 1, further comprising:

e) a piston retardation mechanism operatively connected to at least one chosen from the group: one of said pair of heads and said piston.

12. The single-cylinder, dual head internal combustion engine as recited in claim 11, wherein said piston retardation mechanism comprises at least one chosen from the group: a spring and a magnetic retardation system.

13. The single-cylinder, dual head internal combustion engine as recited in claim 1, further comprising:

e) means for injecting a lubricant into said cylinder to reduce friction between said cylinder and said piston.

14. The single-cylinder, dual head internal combustion engine as recited in claim 13, further comprising:

f) means for providing a lubricant between said outside major surface of said cylinder and said inside surface of said sleeve.

15. The single-cylinder, dual head internal combustion engine as recited in claim 8, further comprising:

e) an electrical control system operatively connected to sensors to sense an operational parameter of said engine and having means to generate an actuation signal for at least one of the group: said intake valve, said exhaust valve, said sparkplug, and an electromagnet;

f) at least one sensor disposed adjacent said hollow cylinder and adapted to provide a signal to said electrical controller representative of at least one selected from the group: a position of said piston in said hollow cylinder, and a position of said sleeve.

16. The single-cylinder, dual head internal combustion engine as recited in claim 15, wherein said at least one sensor comprises a sensor selected from the group: a piston position sensor, and a sleeve position sensor.

17. The single-cylinder, dual head internal combustion engine as recited in claim 15, wherein said at least one sensor comprises a row of sensors having a configuration selected from the group: a row of only piston position sensors, a row of only sleeve position sensors, and a row of intermixed piston position sensors and sleeve position sensors.

18. The single-cylinder, dual head internal combustion engine as recited in claim 17, wherein said rows of sensors are disposed in one of the configuration selected from the group: on a single side of said cylinder, and disposed on two diametrically opposed sides of said cylinder.

19. The single-cylinder, dual head internal combustion engine as recited in claim 9, wherein said intake valve and said exhaust valve comprises an electromagnetically actuated valve selected from the group: an electromagnetically actuated rotary valve, and an electromagnetically actuated linear valve, and wherein said electrical control system comprises driver circuitry operatively connected to selected ones of said an electromagnetically actuated rotary valve, and an electromagnetically actuated linear valve.

20. The single-cylinder, dual head internal combustion engine as recited in claim 1, further comprising:

e) a lubricant injection system operatively connected to said hollow cylinder and adapted to inject a lubricant into an interior region of said hollow cylinder.

* * * * *